US006216685B1

(12) United States Patent
Payne

(10) Patent No.: US 6,216,685 B1
(45) Date of Patent: Apr. 17, 2001

(54) COMMON VENTING OF WATER HEATER AND INDUCED DRAFT FURNACE

(75) Inventor: Peter P. Payne, Park Ridge, IL (US)

(73) Assignee: Gas Research Institute, Chicago, IL (US)

( * ) Notice: Subject to any disclaimer, the term of this patent is extended or adjusted under 35 U.S.C. 154(b) by 0 days.

(21) Appl. No.: 09/303,287

(22) Filed: Apr. 30, 1999

(51) Int. Cl.[7] ..... F24C 1/14

(52) U.S. Cl. ..... 126/80; 126/85 B

(58) Field of Search ..... 126/80, 312, 307 R, 126/314, 86, 307 A, 351, 290, 85 B, 389; 137/487.5; 110/160, 162, 163, 147; 237/19

(56) References Cited

U.S. PATENT DOCUMENTS

| | | | | |
|---|---|---|---|---|
| 3,570,423 | * | 3/1971 | Hemmingson | 126/307 R |
| 4,163,441 | | 8/1979 | Chen . | |
| 4,187,833 | * | 2/1980 | Zahora et al. | 126/307 A |
| 4,262,608 | * | 4/1981 | Jackson | 126/85 B |
| 4,289,730 | | 9/1981 | Tomlinson . | |
| 4,424,792 | | 1/1984 | Shimek et al. . | |
| 4,467,178 | * | 8/1984 | Swindle | 126/351 |
| 4,515,145 | | 5/1985 | Tallman et al. . | |
| 4,557,686 | * | 12/1985 | LaSpisa | 126/35 |
| 4,688,547 | | 8/1987 | Ballard et al. . | |
| 4,750,433 | * | 6/1988 | Guzorek | 126/307 R |
| 4,768,444 | * | 9/1988 | DeWerth et al. | 126/307 R |
| 4,819,587 | * | 4/1989 | Tsutsui et al. | 126/351 |
| 4,906,178 | * | 3/1990 | Goldstein et al. | 126/116 A |
| 4,934,335 | * | 6/1990 | Marlatt | 126/85 B |
| 4,951,651 | | 8/1990 | Shellenberger . | |
| 4,974,579 | | 12/1990 | Shellenberger et al. . | |
| 4,981,262 | * | 1/1991 | Jackson | 126/85 B |
| 4,982,721 | * | 1/1991 | Lynch | 126/116 A |
| 4,994,959 | * | 2/1991 | Ovenden et al. | 431/12 |
| 4,995,375 | * | 2/1991 | Jackson | 126/85 B |
| 5,012,793 | | 5/1991 | Guzorek . | |
| 5,038,751 | | 8/1991 | Riedling . | |
| 5,056,500 | | 10/1991 | Evens . | |
| 5,113,844 | | 5/1992 | Cook . | |
| 5,126,934 | * | 6/1992 | MacFadyen | 137/487.5 |
| 5,165,732 | * | 11/1992 | Townsend | 126/307 R |
| 5,174,271 | | 12/1992 | Seo . | |
| 5,199,385 | * | 4/1993 | Doss | 110/162 |
| 5,255,665 | * | 10/1993 | Windon | 126/290 |
| 5,379,749 | | 1/1995 | Rieke et al. . | |
| 5,598,863 | * | 2/1997 | Kruto | 431/86 |
| 5,732,691 | * | 3/1998 | Maiello et al. | 126/110 R |
| 5,941,230 | * | 8/1999 | Rutz et al. | 126/80 |
| 6,000,391 | * | 12/1999 | Timmons | 126/307 R |
| 6,053,130 | * | 4/2000 | Shellenberger | 110/162 |

OTHER PUBLICATIONS

New Vent Sizing Tables, American Gas Association and Gas Research Institute, 1–3, 12–17, 1990.

Accessory Masonry Chimney Venting Kit Specifications, Inter–City Products Corporation, 1 page, Aug. 1995.

* cited by examiner

*Primary Examiner*—Ira S. Lazarus
*Assistant Examiner*—David Lee
(74) *Attorney, Agent, or Firm*—Pauley Petersen Kinne & Fejer

(57) ABSTRACT

A common, side-wall, Category III or Category IV-vented gaseous fuel-fired furnace and gaseous fuel-fired water heater system having a gaseous fuel-fired furnace having a furnace combustion products exhaust, a gaseous fuel-fired water heater having a water heater combustion products exhaust, and a Category III or Category IV vent in communication with the furnace combustion products exhaust and the water heater combustion products exhaust for venting of the combustion products from the furnace and water heater.

19 Claims, 9 Drawing Sheets

COMMON VENTING OF WATER HEATER AND INDUCED DRAFT FURNACE

BACKGROUND OF THE INVENTION

1. Field of the Invention

This invention relates to gaseous fuel-fired heating appliances and venting systems for such appliances. More particularly, this invention relates to gaseous fuel-fired heating appliances, such as residential furnaces, and gaseous fuel-fired water heating appliances, such as residential water heaters, both of which can be vented through a common, side-wall, PVC vent.

2. Description of Prior Art

Conventional gas heating appliances, such as furnaces, boilers, and water heaters provide the user with safe, economical space and water heating, all the while requiring little maintenance over a relatively long appliance lifetime. These appliances (particularly mid-efficiency, non-condensing configurations) typically use single wall galvanized vent connectors and either a masonry chimney or Type-B vent pipe to vent the flue gases generated by the combustion process during operation of the appliances. The American National Standards Institute (ANSI) categorizes gas appliances based on the vent pressure produced in a special test vent and the difference between the actual temperature and the dew point temperature of the flue gas.

A conventional Category I space heating appliance is one which has a vertical vent which operates under negative static vent pressure with a minimum of condensation. Moisture normally does not condense from the flue gas in Category I appliances because the actual flue gas temperature is generally higher than 140° F. above its dew point temperature. Conventional draft hood equipped appliances are Category I appliances as well as most mid-efficiency, fan-assisted appliances. Mid-efficiency, fan-assisted appliances differ from conventional draft hood appliances by having an induced-draft blower to draw the combustion gases through a heat exchanger and discharge them into a vent. These appliances are classified as Category I appliances if the flue gas temperature is in the same range as the conventional Category I appliance, and if the induced-draft blower and the vent system are designed to maintain a negative pressure in the vent. Venting systems for Category I appliances typically include Type-B vents, lined masonry chimneys, and single wall metal vents.

Category III appliances operate with a positive vent pressure used with a vent gas temperature generally at least 140° F. above its dew point temperature. Because the pressure in the vent is greater than the pressure of the surrounding atmosphere, these appliances require an airtight vent to prevent leakage of flue gases into the residence. An example of a Category III appliance is a mid-efficiency furnace that is vented horizontally through the side-wall of the residence. Venting systems for Category III appliances typically include high temperature plastic and single wall stainless steel metal vents.

Category IV gas heating appliances operate with a positive vent pressure and at a vent-gas temperature less than 140° F. above the dew point temperature. Because the pressure in the vent exceeds that of the surrounding atmosphere and because condensation occurs in the vent, these appliances require an airtight, corrosion-resistant vent that is equipped for condensate disposal. Venting systems for Category IV appliances typically include polyvinylchloride (PVC) or chlorinated polyvinylchloride (CPVC) vents.

From the above discussion it can be seen that the category to which a particular appliance is assigned determines the installation requirements of the venting system for the particular appliance. For example, a Category I appliance may utilize traditional venting materials such as Type-B vent pipe or a masonry chimney, while a Category IV appliance will require an air-tight vent system built from corrosion resistant materials.

The flue gases of gas heating appliances, such as furnaces and water heaters, contain a large amount of water vapor. Because the industry has moved to higher efficiency appliances, and, subsequently, to lower flue gas temperatures, condensation of water and corrosive substances from the flue gases onto vent system surfaces is a major design issue, the consequences of which include the requirement that a building owner with such gas appliances may be required to undergo an expensive and time-consuming vent system replacement.

In an attempt to avoid these costs, several manufacturers have designed appliances with draft hoods that entrain dilution air into the vents. Entraining dilution air into the vents reduces the amount of condensation formed during operation, thereby reducing the number of installations which would require vent system modifications, such as chimney relining. Unfortunately, this process also allows heated room air to escape in an uncontrolled fashion, both while the appliance is operating and while the appliance is idle. The escaping heat increases the heat load on the building, thereby increasing the energy cost associated with controlling the building temperature. In addition, typical draft hood equipped appliances are susceptible to backdrafting, a particularly troublesome problem in multi-story houses.

In buildings provided with gaseous fuel-fired water heaters and gaseous fuel-fired furnaces, the water heater is frequently vented in parallel with the furnace through a common venting system for Category I appliances including Type-B vent, lined masonry chimney, and single wall metal vent. However, if the furnace is replaced with a furnace suitable for venting through a side-wall venting system, the water heater may no longer by itself be compatible with the venting system of the furnace, resulting in an expensive repair or replacement of the water heater vent system or replacement of the gaseous fuel-fired water heater with an electric water heater. Or, if in new construction the gaseous fuel-fired water heater is the only appliance requiring a vertical vent, the choice of an electric water heater becomes more attractive for first cost reason (even though life-cycle cost of electric water heating may be much more due to energy cost differences between electricity and gas).

SUMMARY OF THE INVENTION

Accordingly, it is one object of this invention to provide a gaseous fuel-fired mid-efficiency furnace and gaseous fuel-fired water heater system which permits both the gaseous fuel-fired mid-efficiency furnace and the gaseous fuel-fired water heater to vent through a common, side-wall Category III or IV vent of any approved design or material, including PVC.

It is another object of this invention to provide a gaseous fuel-fired mid-efficiency furnace and gaseous fuel-fired water heater system which enables both the gaseous fuel-fired mid-efficiency furnace and the gaseous fuel-fired water heater to vent through a common Category III or IV vent by time-sharing of the vent system by each appliance in turn.

It is yet another object of this invention to provide a gaseous fuel-fired mid-efficiency furnace and a gaseous fuel-fired water heater system which permits both the gaseous fuel-fired mid-efficiency furnace and the gaseous fuel-fired water heater to vent through a common PVC Category III or IV vent during simultaneous operation of both appliances.

These and other objects of this invention are addressed by a common, side-wall, Category III or IV-vented gaseous fuel-fired furnace and gaseous fuel-fired water heater system comprising a gaseous fuel-fired furnace having a furnace combustion products exhaust, a gaseous fuel-fired water heater having a water heater combustion products exhaust, and a Category III or IV vent in communication with both the furnace combustion products exhaust and the water heater combustion products exhaust. In accordance with one embodiment of this invention, the gaseous fuel-fired furnace is convertible between a low temperature vent mode and a high temperature vent mode. In accordance with a preferred embodiment, the system of this invention also comprises a priority selection means for selecting the priority of operation of the furnace and/or the water heater, which priority selection means are operatively connected to the furnace and the water heater.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

The invention claimed herein is a common, side-wall, Category III or IV-vented gaseous fuel-fired appliance and gaseous fuel-fired water heater system comprising a Category III or Category IV gaseous fuel-fired appliance having an appliance combustion products exhaust, a gaseous fuel-fired water heater having a water heater combustion products exhaust, and a Category III or IV vent in communication with both the Category III or IV appliance combustion products exhaust and the water heater combustion products exhaust. In order to insure that the vent gas temperature is safely within vent material operating limits, the system further comprises means for admitting sufficient dilution air into the vent system by means of an induced-draft blower to insure that both the dew point and the temperature of the flue gases are sufficiently depressed.

Figure 1:
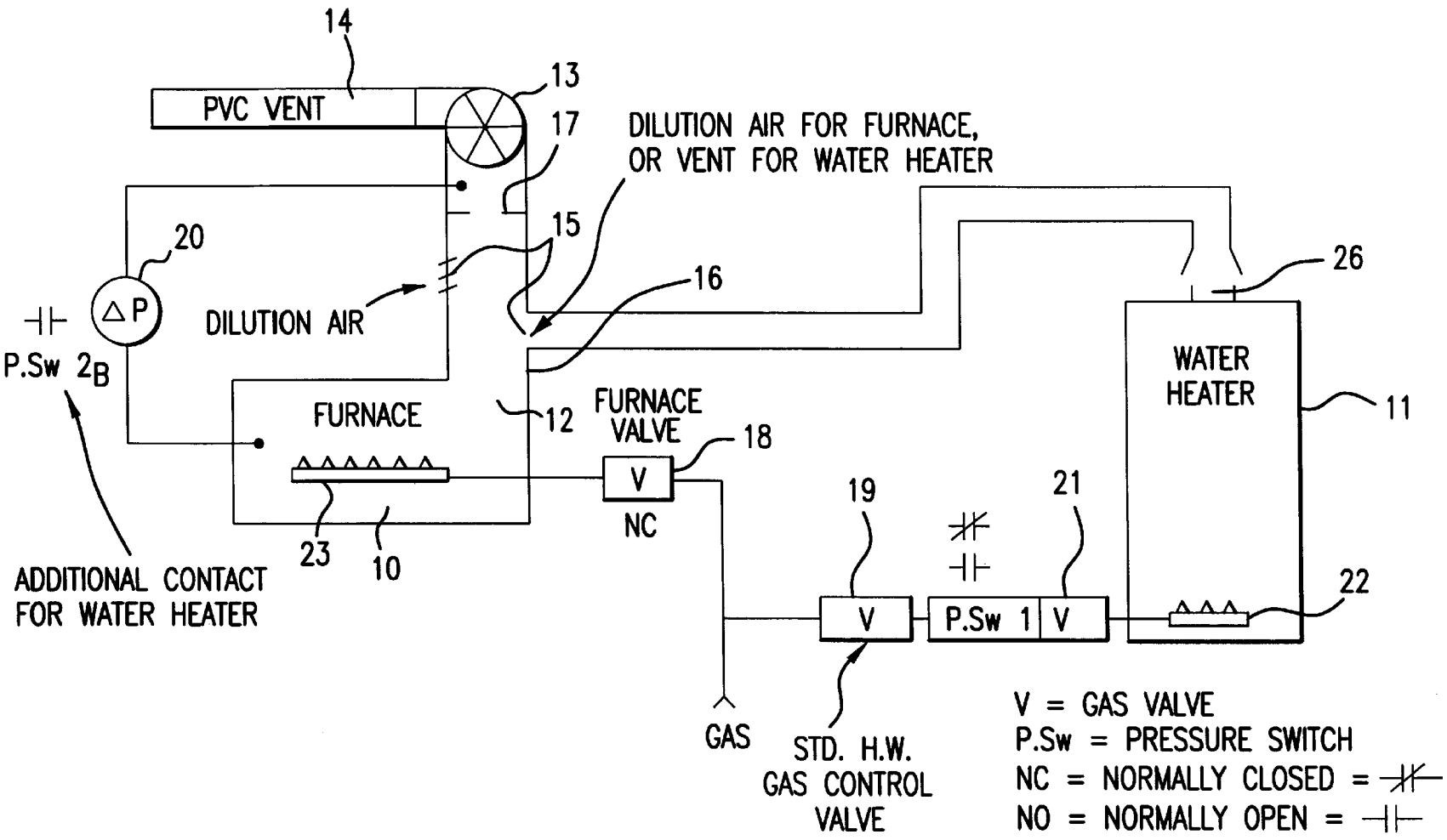
FIG. 1 is a schematic diagram of a common, side-wall, Category III or IV-vented, single-fire mid-efficiency furnace and water heater system set up for water heater priority in accordance with one embodiment of this invention.

Although described herein in the context of a gaseous fuel-fired furnace, the invention claimed herein is equally applicable to other gaseous fuel-fired appliances, and there is no intent to limit the scope of the claimed invention to the specific embodiments described herein. As shown in FIG. 1, the system of this invention comprises a Category III or IV gaseous fuel-fired furnace 10 and a gaseous fuel-fired water heater 11, the gaseous fuel-fired furnace having a furnace combustion products exhaust 12 and the gaseous fuel-fired water heater having a water heater combustion products exhaust 26. Vent 14 is in communication with furnace combustion products exhaust 12 and water heater combustion products exhaust 26. Disposed between vent 14 and both of furnace combustion products exhaust 12 and water heater combustion products exhaust 26 is induced-draft fan 13 which pulls dilution air into vent 14 through dilution means comprising at least one dilution air intake. In accordance with one embodiment of this invention, said dilution air intake is drawn through opening 15 formed by walls 16 of furnace combustion products exhaust 12. Disposed between dilution air intake 15 and induced draft blower 13 is flow control orifice 17. Gaseous fuel is provided to gaseous fuel-fired furnace 10 from a gas supply controlled by furnace valve 18. Similarly, gaseous fuel is provided to gaseous fuel-fired water heater 11 from a gaseous fuel supply controlled by hot water heater gas control valve 19 and water heater valve 21.

Figure 9:
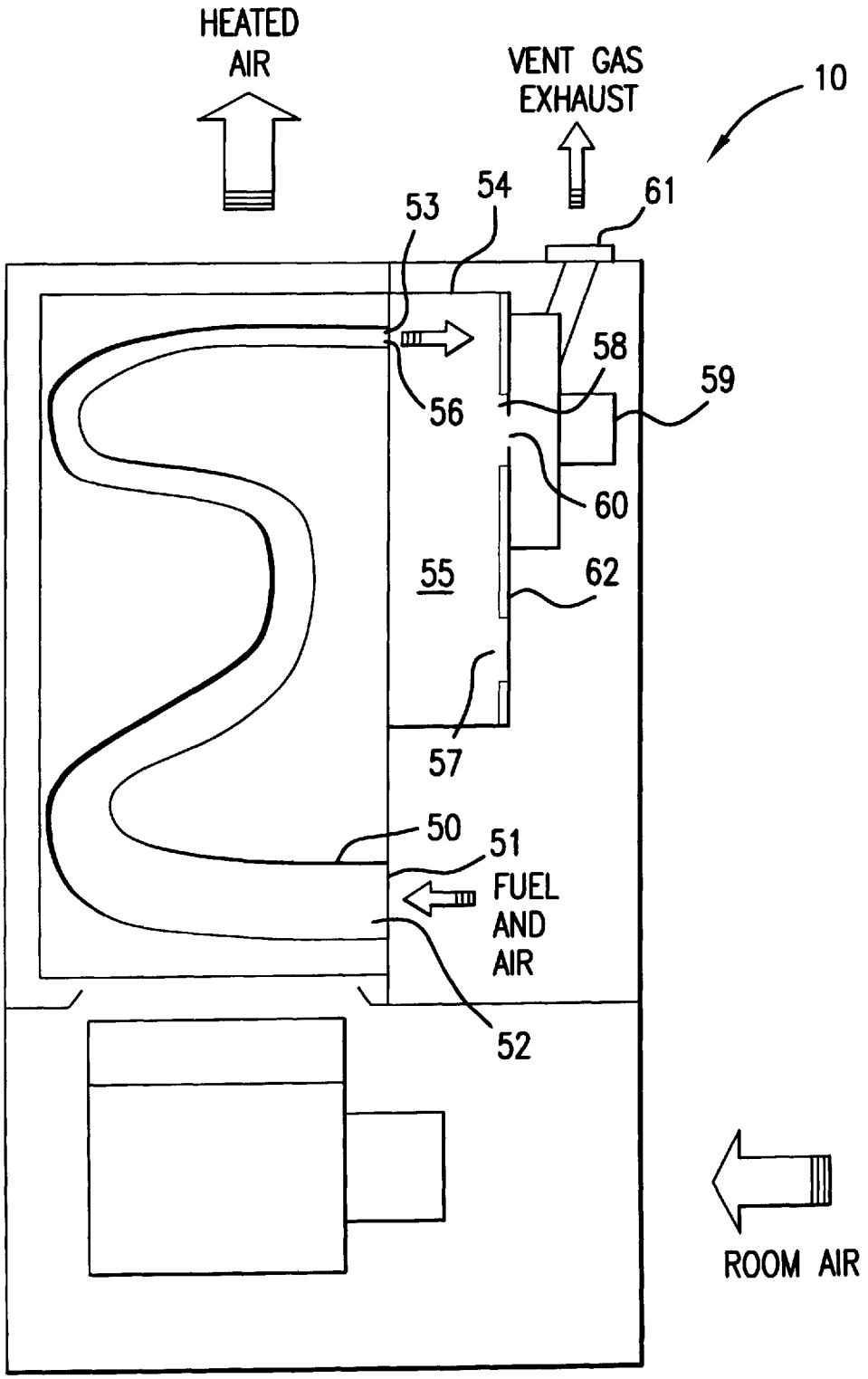
FIG. 9 is a schematic diagram of a multi-category furnace suitable for use in the system of this invention.

In accordance with a particularly preferred embodiment of this invention, gaseous fuel-fired furnace 10, as shown in FIG. 9, comprises at least one combustion chamber wall which defines a combustion chamber 50 having a gaseous fuel inlet 51, an oxidant inlet 52, and a furnace combustion products exhaust 53. At least one mixing chamber wall 54 defines a mixing chamber 55 having a flue gas inlet 56 in fluid communication with the furnace combustion products exhaust 53, a dilution air inlet 57, and a mixing chamber flue gas outlet 58. An induced draft blower 59 having a blower flue gas inlet 60 in communication with the mixing chamber flue gas outlet 58 is secured to the mixing chamber wall 54. The induced draft blower 59 is provided with a vent gas outlet 61 which is connectable to a Category III or IV horizontal vent through a building side-wall.

In accordance with one embodiment of this invention, the furnace is convertible between a Category I, III and IV furnace. In this case, the furnace further comprises means for converting the appliance between a high temperature flue gas vent mode and a low temperature flue gas vent mode, which means is disposed between the mixing chamber and the induced draft blower. Said means for converting the furnace between a high temperature flue gas vent mode and a low temperature flue gas vent mode comprises an orifice plate 62 disposed between the mixing chamber 55 and the induced draft blower 59 resulting in the sealing off of the dilution air inlet 57. By insertion or removal of orifice plate 62, the furnace is convertible between a Category I, Category III, or Category IV appliance.

In practice, the design of a conventional gaseous fuel-fired furnace is modified at the factory to permit it to be fuel selected to either Category I, Category III, or Category IV by the installer. The unit as shipped from the factory is self-complete and only needs the installer to select which mode of operation is desired. Water heater implementation may be a separate kit that supplies a gas valve and gas pressure switch required for water heater modification. Minor changes may be required in the factory's furnace controls to be compatible with the time-shared control concept of this invention. A vent tie-in point must be factory provided on the furnace so as to permit the water heater to vent through the furnace vent system.

The system of this invention employs two priority operation strategies for each of two embodiments, one of which utilizes an integral kit design and the other of which utilizes an external kit design. The simplest strategy provides water heater priority operation; that is, whenever there is a call for water heat, the vent system is available for use by the water heater. If the furnace calls for space heat in the middle of a water heat cycle, operation of the furnace is deferred until the water heat call is satisfied. At that point, operation of the furnace can be initiated. Alternatively, if the furnace is in operation when a call for water heat is initiated, operation of the furnace is interrupted until the water heat demand is satisfied, at which time the furnace can resume operation.

An alternate control strategy is to include a switch and other control components to permit field selection as to which appliance, the water heater or the furnace, has operating priority.

To accommodate these add-on conversion kits, the base furnace must have some factory design alteration both in its venting geometry and in its control wiring. These accommodations are expected to be extremely nominal in cost which will be warranted in the added flexibility it provides for meeting various installation requirements.

Yet a further configuration requires no factory modification of the furnace, but rather provides a field-installable kit that is added external to the furnace on the vent system that draws in the required vent dilution air. Again, an optional kit can be purchased to adapt a water heater to the system so that both the furnace and water heater can be common-vented through the Category III or IV vent system.

Given a large enough vent and a large enough capacity induced draft blower, simultaneous operation and venting of both the furnace and the water heater is possible and is to be considered within the scope of this invention.

Figure 2:
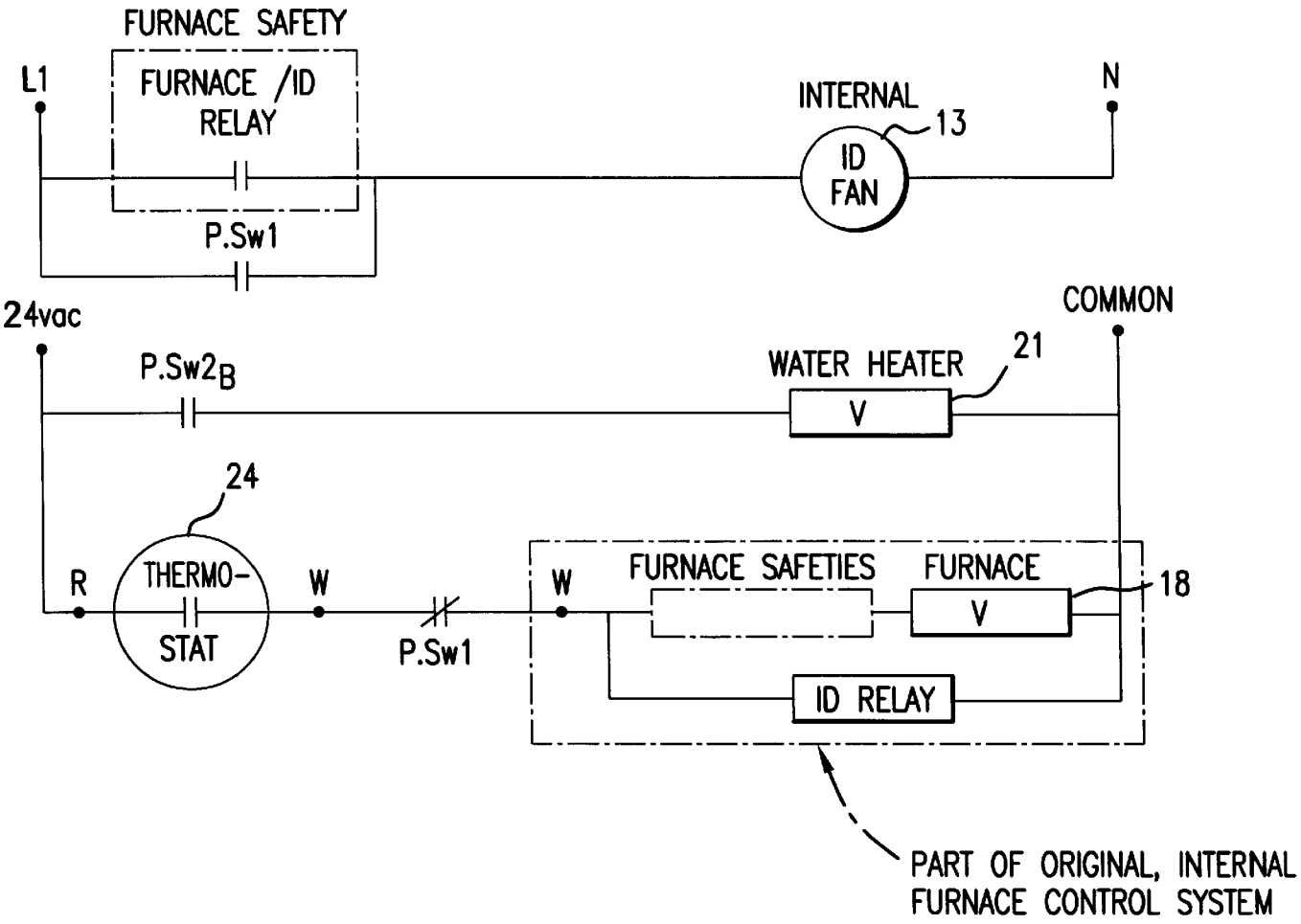
FIG. 2 is a schematic diagram of a control system for operation of the common, side-wall, Category III or IV-vented, single-fire mid-efficiency furnace and water heater system with a water heater priority configuration in accordance with one embodiment of this invention.

FIGS. 1–4 show a configuration of the system of this invention utilizing an integral blower design with a water heater vent kit whereas FIGS. 5–8 show a second configuration which utilizes an external blower kit design which allows adaptation to any unmodified new or in-place furnace. FIGS. 1 and 2 show a common, side-wall, Category III or IV-vented, single-fire mid-efficiency furnace and water heater utilizing an internal blower design with a water heater vent kit wherein the water heater is given priority. Starting from an initial condition where both the furnace and water heater are off, the sequence of operation of this system is as follows.

For operation of the water heater without the furnace operating, upon receipt of a call for water heat, standard hot water gas control valve 19 opens and pressure switch P.Sw1, which is normally open, closes, starting induced draft fan 13. Pressure differential sensor 20 is used to establish the existence of air flow from furnace 10 through flow control orifice 17. Upon determination of the existence of air flow, pressure switch P.Sw$\mathbf{2}_B$, which is normally open, closes, enabling water heater valve 21 to open, igniting water heater burner 22.

For furnace operation without the water heater operating, upon receipt of a call for space heat, a furnace/ID relay, which is normally open as shown in FIG. 2, closes, starting induced draft fan 13. When all the furnace safeties are satisfied, furnace valve 18 is energized through pressure switch P.Sw1, which is normally closed, to ignite furnace burner 23.

If water heater 11 calls for water heat while furnace 10 is operating, pressure switch P.Sw1, which is normally closed, opens, thereby disabling furnace valve 18, shutting down furnace burner 23 (and a circulating blower (not shown) if on "automatic" setting at thermostat 24). Pressure switch P.Sw1, which is normally open, closes, thereby insuring continued operation of induced draft fan 13. Pressure switch P.Sw$\mathbf{2}_B$, which is normally open, remains closed resulting in the opening of water heater valve 21 and ignition of water heater burner 22. Water heater 11 operates in this manner until satisfied, at which point control is then turned back over to furnace 10 to finish its interrupted heating cycle. Although the water beater valve 21 is energized when the furnace is operating (due to pressure switch P.Sw$\mathbf{2}_B$, which is normally open, being closed) water heater 11 is not operational because gas control valve 19 is not calling for hot water.

Figure 3:
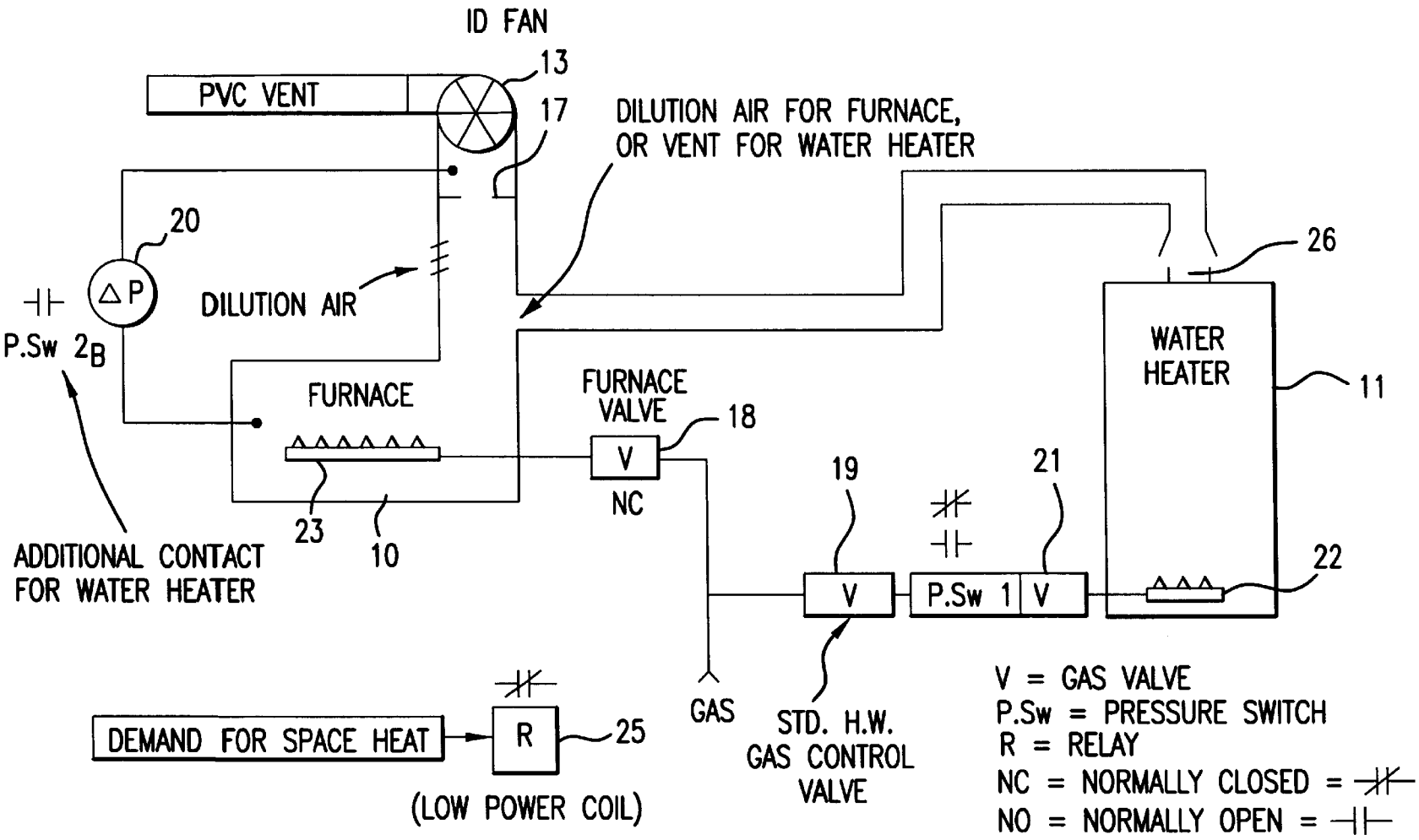
FIG. 3 is a schematic diagram of a common, side-wall, Category III or IV-vented, single-fire mid-efficiency furnace and water heater system in which the priority of the furnace and water heater is selectable in accordance with one embodiment of this invention.
Figure 4:
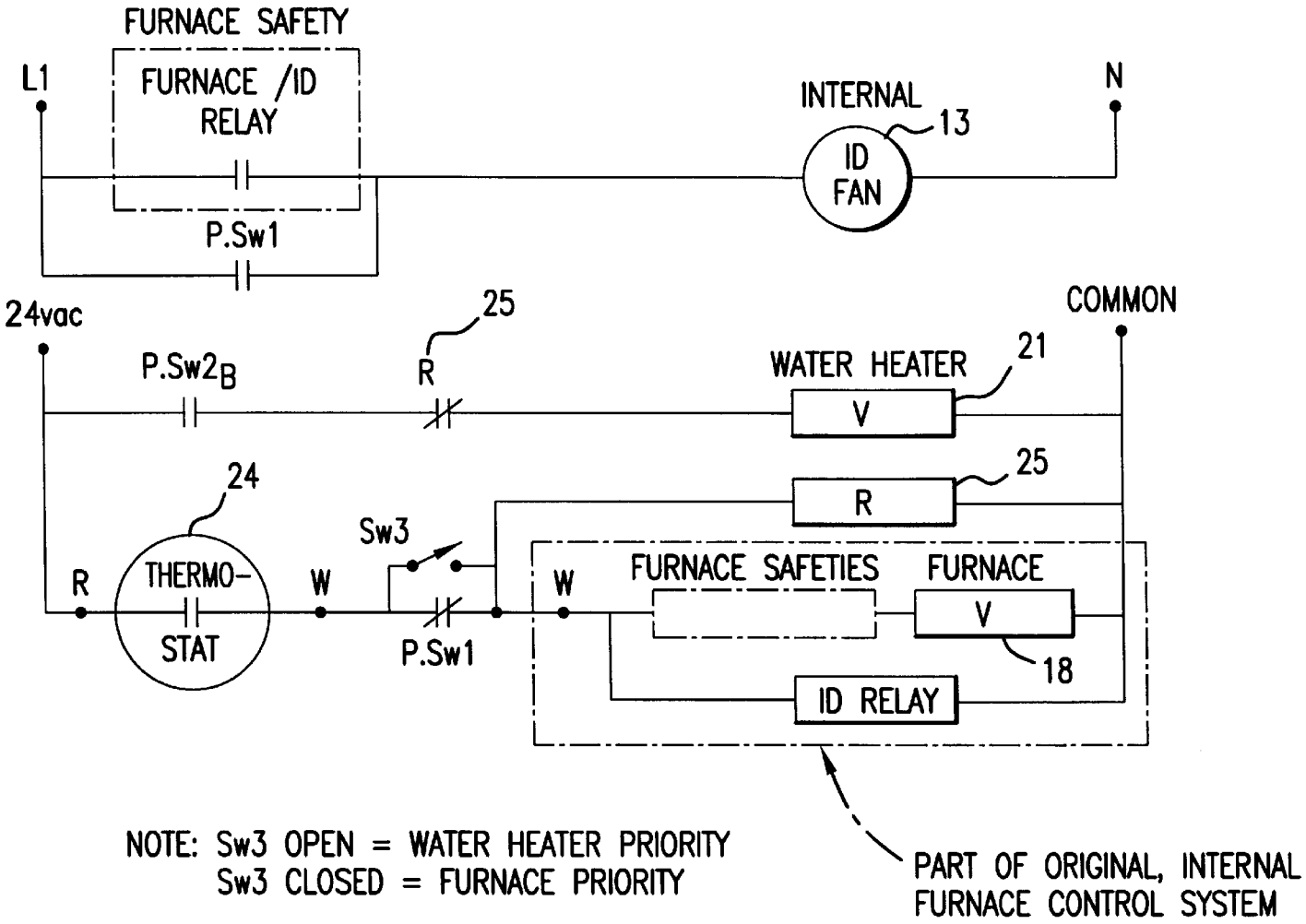
FIG. 4 is a schematic diagram of a control system for a common, side-wall, Category III or IV-vented, single-fire mid-efficiency furnace and water heater which is selectable between furnace and water heater priority in accordance with one embodiment of this invention.

For embodiments of the system of this invention utilizing an integral blower design and water heater vent kit, selectable priority is achieved in accordance with the diagram shown in FIGS. 3 and 4. For water heater operation without furnace operating, upon receipt of a call for water heat, gas control valve 19 opens and pressure switch P.Sw1, which is normally open, closes, starting induced draft fan 13. Differential pressure sensor 20 senses the flow of air across flow control orifice 17 causing pressure switch P.Sw$\mathbf{2}_B$ to close. Pressure switch P.Sw$\mathbf{2}_B$ and relay R25 which is normally closed, enable water heater gas valve 21 to open and ignite water heater burner 22.

For furnace operation without water heater operation, the sequence of operation is as follows. Upon demand for space heat, the furnace/induced draft relay, shown in FIG. 4, which is normally open, closes, starting induced draft fan 13. A low power coil for relay R25 is energized through thermostat 24 and through pressure switch P.Sw1 which is normally closed. When all furnace safeties shown in FIG. 4 are satisfied, furnace valve 18 is energized through pressure switch P.Sw1, which is normally closed, to ignite furnace burner 23.

If water heater 11 calls for water heat while furnace 10 is operating, pressure switch P.Sw1, which is normally closed, opens, disabling furnace valve 18, shutting down furnace burner 23 (and the circulating blower (not shown) if thermostat 24 is on an "automatic" setting). Low power coil relay 25 is deenergized and relay R25, which is normally closed, closes. Pressure switch P.Sw1, which is normally open, closes, insuring continued operation of induced draft fan 13. Pressure switch P.Sw$2_B$, which is normally open, remains closed and water heater valve 21 is energized to open and ignite water heater burner 22. Water heater 11 operates until satisfied at which time control is then turned back over to furnace 10 to finish its interrupted heating cycle.

For sequence of operation with priority given to furnace 10 (FIG. 4), switch Sw3 is closed. Upon a call for space heat, the sequence for furnace operation without water heater operation is as follows. Furnace/ID relay, which is normally open, closes, starting induced draft fan 13. Relay R25 is energized through thermostat 24 and switch Sw3. When all furnace safeties as shown in FIG. 4 are satisfied, furnace valve 18 is energized through switch Sw3 to ignite furnace burner 23.

For water heater operation without furnace operation, the sequence of operation is as follows. Upon a call for water heat, water heater gas control valve 19 opens and pressure switch P.Sw1, which is normally open, closes, starting induced draft fan 13. Upon detection of air flow through flow control orifice 17 by differential pressure sensor 20, pressure switch P.Sw$2_B$ closes. Pressure switch P.Sw$2_B$ and relay R25, which is normally closed, enable water heater valve 21 to open and ignite water heater burner 22.

If furnace 10 calls for space heat while water heater 11 is operating, induced draft fan 23 is maintained "on" through the furnace/ID relay shown in FIG. 4. Through switch Sw3, furnace valve 18 is energized to open and ignite furnace burner 23. A low power coil for relay R25 is energized through switch Sw3. Relay R25, which is normally closed, opens, resulting in the disabling of water heater valve 21, shutting off water heater burner 22, even though the water heat demand is not satisfied. Furnace 10 continues to operate until the call for space heat is satisfied at which point control is then returned back over to water heater 11 to finish its interrupted heating cycle. Because relay R25, which is normally closed, is held open while furnace burner 23 is operating, water heater operation is disabled until the furnace call for heat is satisfied.

Figure 5:
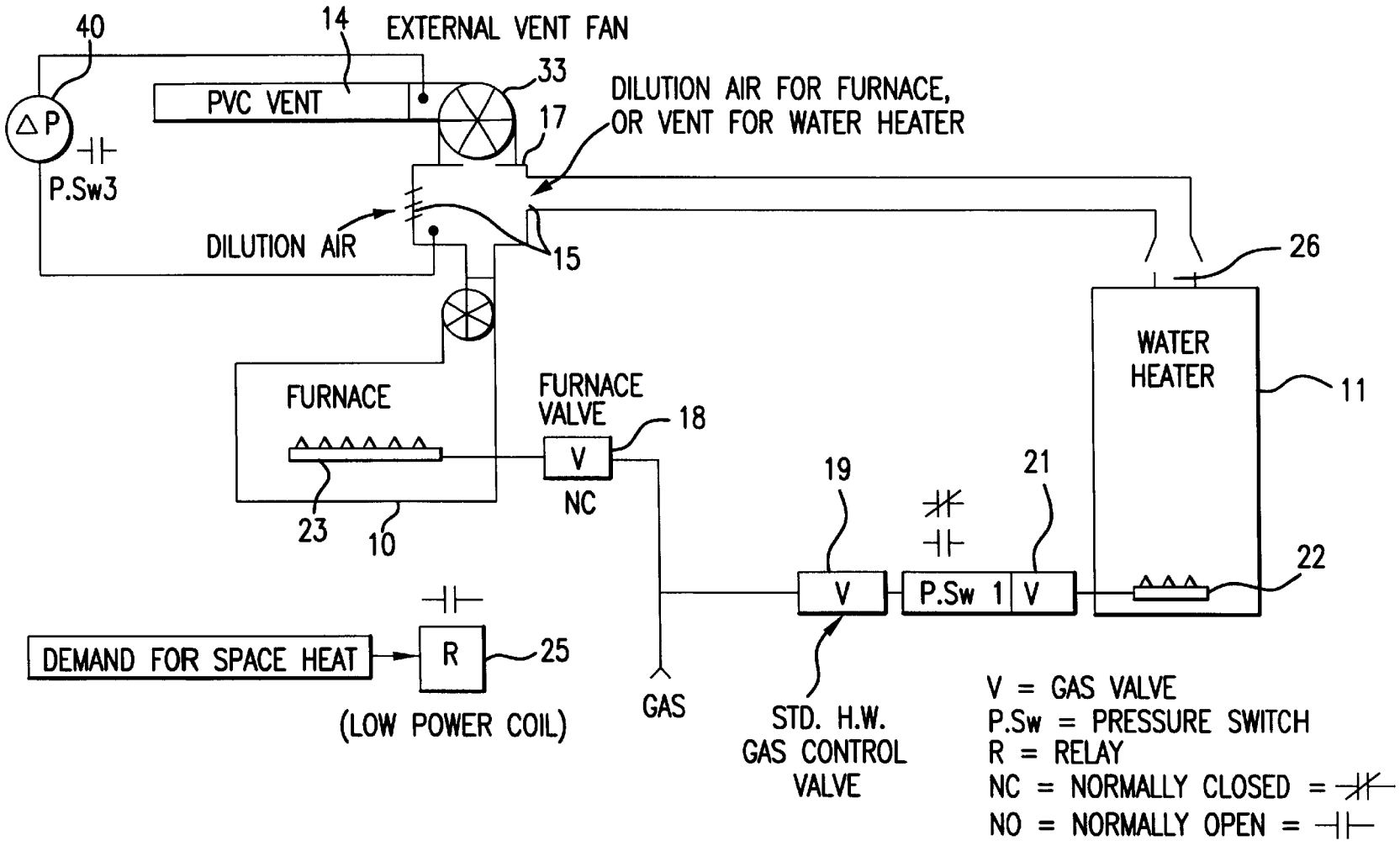
FIG. 5 is a schematic diagram of an externally assisted blower kit for control of a common, side-wall, Category III or IV-vented, single-fire mid-efficiency furnace and water heater system having a water heater priority configuration in accordance with one embodiment of this invention.
Figure 6:
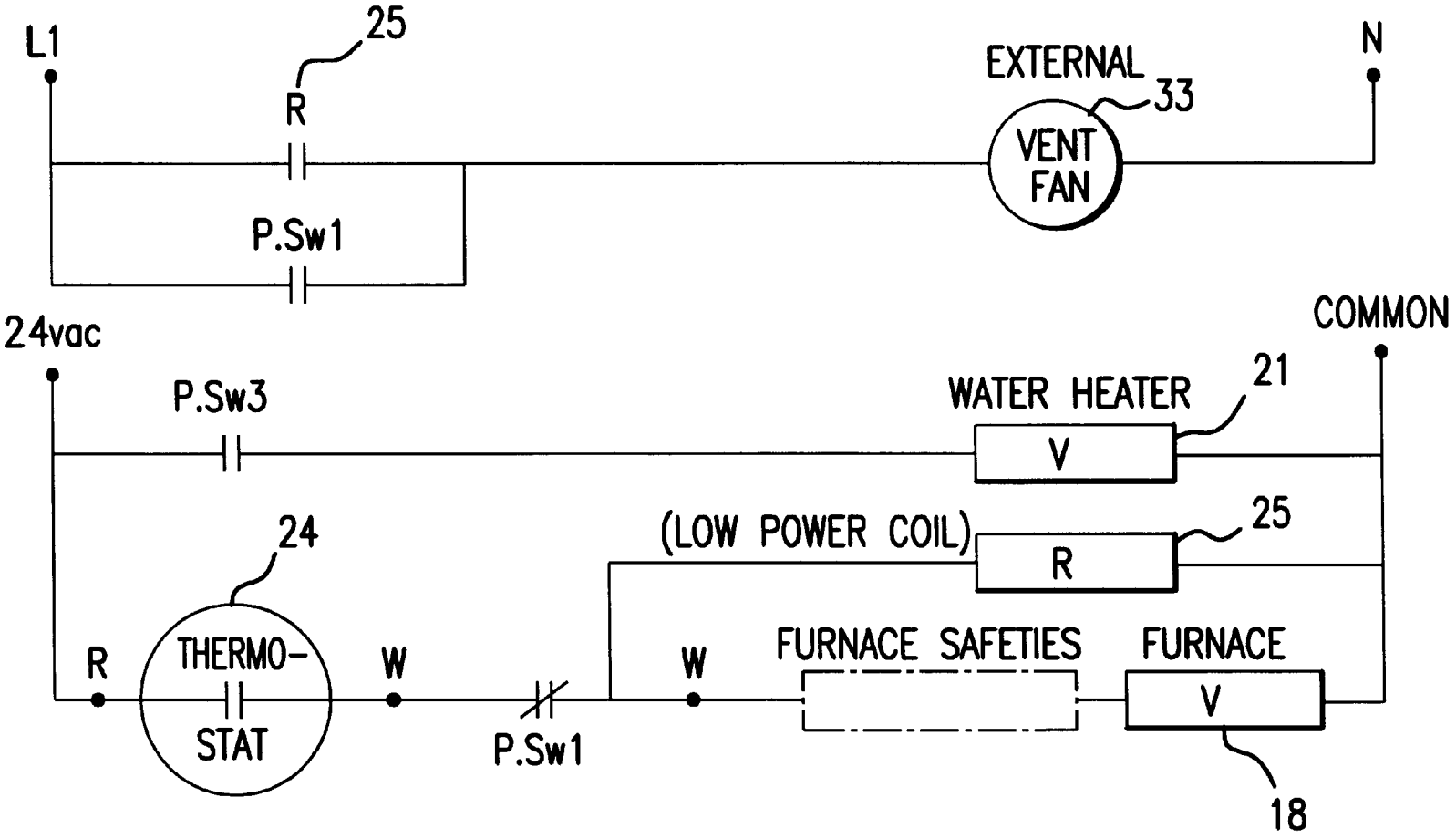
FIG. 6 is a control system for an externally assisted blower kit for control of a common, side-wall, Category III or IV-vented, single-fire mid-efficiency furnace and water heater system having a water heater priority only configuration in accordance with one embodiment of this invention.

Operation of the system in accordance with this invention utilizing an external kit as discussed hereinabove is shown in FIGS. 5, 6, 7 and 8. FIGS. 5 and 6 show the system in accordance with one embodiment of this invention with water heater priority as the basis of operation. The initial condition shown is for both furnace 10 and water heater 11 being off.

For water heater operation without furnace operation, upon a call for water heat, water heater gas control valve 19 opens and pressure switch P.Sw1, which is normally open, closes, starting external vent fan 33. Upon establishing air flow across flow control valve 17 by differential pressure sensor 40, pressure switch P.Sw3 closes, enabling water heater valve 21 to open and ignite water heater burner 22.

For furnace operation without water heater operation, upon call for space heat, a low power coil for relay R25 is energized through thermostat 24 and through pressure switch P.Sw1, which is normally closed. Relay R25, which is normally open, closes, energizing external vent fan 33. Pressure switch P.Sw3 closes, proving air flow. When all internal furnace safeties are satisfied, furnace valve 18 is energized through pressure switch P.Sw1, which is normally closed, to ignite furnace burner 23.

If water heater 11 calls for water heat while furnace 10 is operating, pressure switch P.Sw1, which is normally closed, opens, disabling furnace valve 18 and shutting down furnace burner 23. Pressure switch P.Sw1, which is normally open, closes, thereby insuring continued operation of external vent fan 33. A low power coil for relay R25 is deenergized and relay R25, which is normally closed, closes. Pressure switch P.Sw3, which is normally open, closes and water heater valve 21 is energized to open and ignite water heater burner 22. Water heater burner 22 operates until satisfied at which point control is then turned back over to furnace 10 to finish its interrupted heating cycle.

Figure 7:
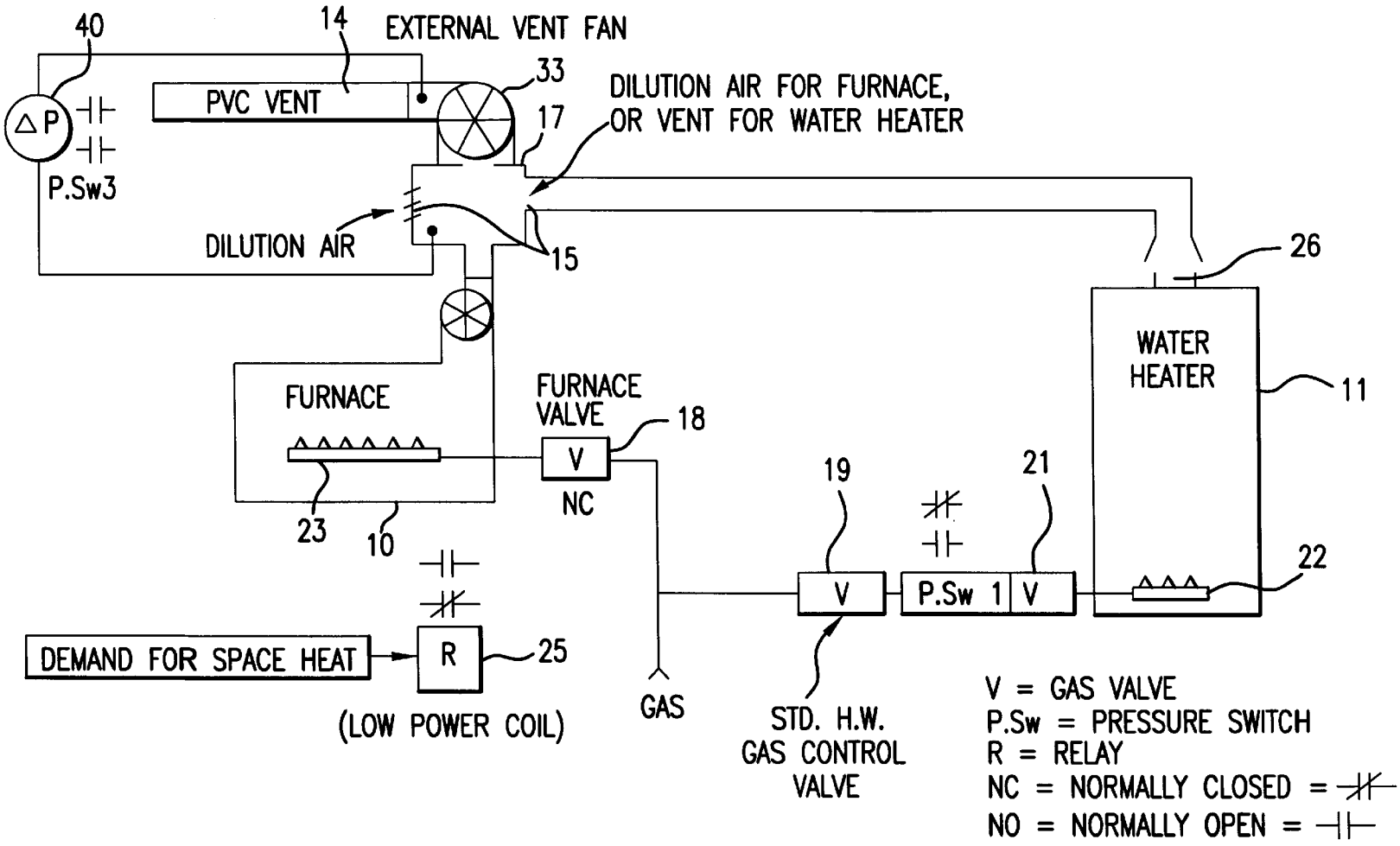
FIG. 7 is a schematic diagram of an externally assisted blower kit for control of a common,, side-wall, Category III or IV-vented, single-fire mid-efficiency furnace and water heater system which is selectable between the furnace and water heater in accordance with one embodiment of this invention.
Figure 8:
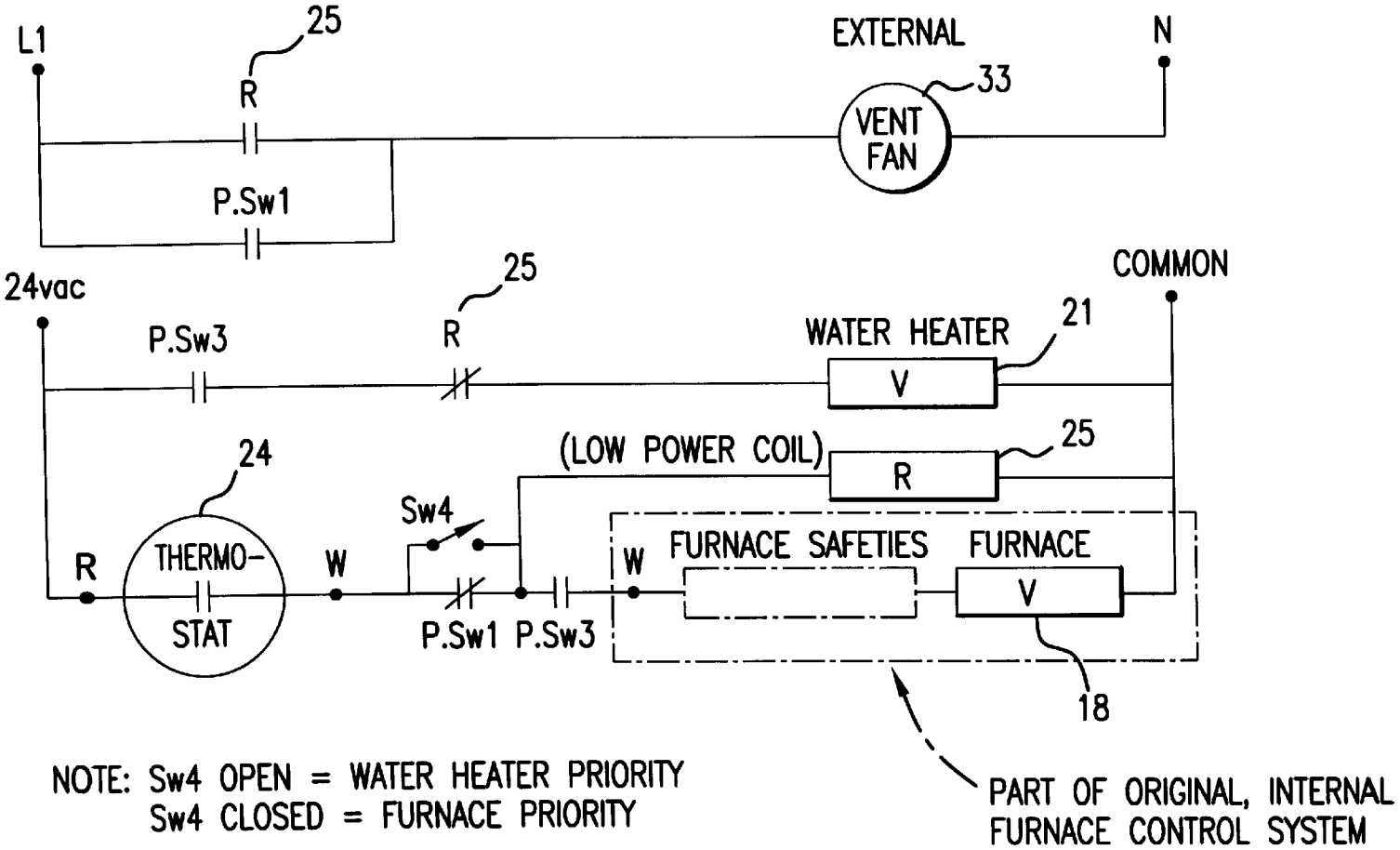
FIG. 8 is a schematic diagram of an externally assisted blower kit for control of a common, side-wall, Category III or IV-vented, single-fire mid-efficiency furnace and water heater system which is selectable between a furnace and water heater priority in accordance with one embodiment of this invention.

A system in accordance with one embodiment of this invention having an external kit design and providing for selectable priority is shown in FIGS. 7 and 8. For water heater priority, switch Sw4, shown in FIG. 8 is open. Again, the initial condition shown in FIGS. 7 and 8 is for both furnace 10 and water heater 11 being off. In accordance with this embodiment, upon call for water heat, water heater gas control valve 19 opens and pressure switch P.Sw1, which is normally open, closes, starting external vent fan 33. Upon establishing air flow across flow control orifice 17 by differential pressure sensor 40, pressure switch P.Sw3 closes. Pressure switch P.Sw3 and relay R25, which is normally closed, enable water heater valve 21 to open and ignite water heater burner 22.

For furnace operation without water heater operation, upon call for space heat, a low power coil for relay R25 is energized through thermostat 24 and through pressure switch P.Sw1, which is normally closed. Relay R25, which is normally open, closes, energizing external vent fan 33. Pressure switch P.Sw3, which is normally open, closes, proving air flow. While all internal furnace safeties are satisfied, furnace valve 18 is energized through pressure switch P.Sw1, which is normally closed, to ignite furnace burner 23.

In accordance with this embodiment, if water heater 11 calls for water heat while furnace 10 is operating, pressure switch P.Sw1, which is normally closed, opens, thereby disabling furnace valve 18 and shutting down furnace burner 23. A low power coil for relay R25 is deenergized and relay R25, which is normally closed, closes. Pressure switch P.Sw1, which is normally open, closes insuring continued operation of the external vent fan 33. Upon the closing of pressure switch P.Sw3, water heater valve 21 is energized to open and ignite water heater burner 22. Water heater 11 operates until satisfied at which point control is then turned back over to furnace 10 to finish its interrupted heating cycle.

For providing furnace priority in accordance with the embodiment of FIGS. 7 and 8, switch Sw4 is closed and the sequence of operation, where the initial condition of the system is that both furnace 10 and water heater 11 are off, is as follows.

For furnace operation without water heater operation, upon call for space heat, a low power coil for relay R25 is energized through thermostat 24 and through switch Sw4. Relay R25, which is normally open, closes, thereby energizing external vent fan 33. Pressure switch P.Sw3, which is normally open, closes. When all internal furnace safeties are satisfied, furnace valve 18 is energized through switch Sw4 resulting in ignition of furnace burner 23.

For water heater operation without furnace operation, upon call for water heat, water heater gas control valve 19 opens. Pressure switch P.Sw1, which is normally open, closes, starting external vent fan 33. Upon establishing air flow across flow control orifice 17 by differential pressure sensor 40, pressure switch P.Sw3 closes. As a result, pressure switch P.Sw3 and relay R25, which is normally closed, enable water heater valve 21 to open and ignite water heater burner 22.

If furnace 10 calls for space heat while water heater 11 is operating, a low power coil for relay R25 is energized through switch Sw4, and relay R25, which is normally open, closes to maintain external vent fan 33 in an "on" condition. Pressure switch P.Sw3, which is normally open, closes and furnace valve 18 is energized to open and ignite furnace burner 23. Relay R25, which is normally closed, opens, thereby disabling water heater valve 21 and shutting off water heater burner 22 even though the water heater demand is not satisfied. Furnace 10 continues to operate until its call for space heat has been satisfied at which point control is then returned back over to water heater 11 to finish its interrupted heating cycle.

In all cases, it should be noted that the low power coil for relay R25 should draw less than or equal to 100 ma at 24 v to prevent undue effect on the current-operated anticipator in thermostat 24. This assumes that the coil for furnace valve 18 current draw is greater than or equal to 1 amp at 24 v.

In accordance with one embodiment, with appropriate configuration and sequence changes, the function of the differential pressure flow proving contacts, $P.Sw_{2B}$, could be performed instead by adding a temperature sensor on the water heater draft hood such that if adequate power venting does not occur, the temperature sensor detects vent spillage from the draft hood and disables further water heater operation unless or until the vent fault is rectified.

In accordance with another embodiment, the furnace is a modulating or multi-speed/multi-firing rate unit. When only a lower level of space heating is required (for example 30,000 Btuh from a nominal 80,000 Btuh furnace), the water heater can be enabled to operate simultaneously with the furnace if the combined vent gas temperatures and volumes are less than the furnace alone operating at full output. It is also possible for this technology to work with high efficiency space heating and/or water heating equipment. By high efficiency we mean an appliance operating at greater than about 85% efficiency.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A common, side wall, vented gaseous fuel-fired appliance and gaseous fuel-fired water heater system comprising:

a gaseous fuel-fired appliance having an appliance combustion products exhaust;

a gaseous fuel-fired water heater having a water heater combustion products exhaust;

a positive pressure vent in communication with said appliance combustion products exhaust and said water heater combustion products exhaust, said positive pressure vent suitable for venting appliance combustion products and water heater combustion products at a vent pressure greater than a surrounding atmosphere pressure; and a priority selection means for selecting priority of operation of one of said gaseous fuel-fired appliance and said water heater operatively connected to said gaseous fuel-fired appliance and said water heater.

2. A system in accordance with claim 1 further comprising means for converting said gaseous fuel-fired appliance between a low temperature vent mode and a high temperature vent mode.

3. A system in accordance with claim 1, wherein said gaseous fuel-fired appliance comprises means for modulating output capacity of said gaseous fuel-fired appliance.

4. A system in accordance with claim 3 further comprising means for operating said gaseous fuel-fired appliance at a reduced output, whereby simultaneous operation of said appliance and said water heater is enabled.

5. A system in accordance with claim 1 further comprising a controllable appliance gaseous fuel valve in communication with said gaseous fuel-fired appliance, said appliance gaseous fuel valve controlling a flow of a gaseous fuel to said gaseous fuel-fired appliance, and a controllable water heater gaseous fuel valve in communication with said water heater, said water heater gaseous fuel valve controlling a flow of said gaseous fuel to said water heater.

6. A system in accordance with claim 5 further comprising control means for controlling said appliance gaseous fuel valve and said water heater gaseous fuel valve.

7. A system in accordance with claim 1, wherein at least one of said gaseous fuel-fired appliance and said gaseous fuel-fired water heater is a high efficiency appliance.

8. A system in accordance with claim 1 further comprising an integral blower kit.

9. A system in accordance with claim 1 further comprising an external blower kit.

10. A system in accordance with claim 1 further comprising dilution means for diluting appliance combustion products disposed downstream of said appliance combustion products exhaust.

11. A system in accordance with claim 10, wherein said dilution means comprises a dilution air intake.

12. A system in accordance with claim 11 further comprising an induced draft fan disposed between said positive pressure vent and said dilution means, said induced draft fan in communication with said positive pressure vent, said appliance combustion products exhaust, and said water heater combustion products exhaust.

13. A system in accordance with claim 11, wherein said dilution means further comprises a flow control orifice disposed between said dilution air intake and said positive pressure vent.

14. A common, side-wall, vented gaseous fuel-fired furnace and gaseous fuel-fired water heater system comprising:

a gaseous fuel-fired furnace comprising a combustion chamber, a gaseous fuel input in communication with said combustion chamber, a furnace combustion products exhaust in communication with said combustion chamber, controllable dilution air means for controllably introducing dilution air into said furnace combustion products in said furnace combustion products exhaust, and a flow control orifice disposed downstream of said controllable dilution air means proximate an outlet of said furnace combustion products exhaust;

a gaseous fuel-fired water heater comprising a water heater combustion chamber having a water heater gaseous fuel input and a water heater combustion products exhaust;

a positive pressure vent suitable for exhausting a vent gas having a vent gas temperature one of at least 140° F. above its dew point temperature and less than 140° F. above said dew point temperature at a pressure above atmospheric pressure in communication with said furnace combustion products exhaust and said water heater combustion products exhaust; and priority selection means for selecting priority of operation of one of said furnace and said water heater operatively connected to said furnace and said water heater.

15. A common, side-wall, vented gaseous fuel-fired furnace and gaseous fuel-fired water heater system in accordance with claim 14, wherein a flow control orifice is disposed in said communication between said positive pressure vent and said furnace combustion products and water heater combustion products exhausts.

16. A common, side-wall, vented gaseous fuel-fired furnace and gaseous fuel-fired water heater system in accordance with claim 15, wherein said furnace combustion products exhaust forms at least one dilution air inlet upstream of said flow control orifice.

17. A common, side-wall, vented gaseous fuel-fired furnace and gaseous fuel-fired water heater system in accordance with claim 14, wherein said gaseous fuel-fired furnace is a multi-category furnace.

18. A common, side-wall, vented gaseous fuel-fired furnace and gaseous fuel-fired water heater system in accordance with claim 14 further comprising a controllable furnace gaseous fuel valve in communication with said furnace, said furnace gaseous fuel valve controlling a flow of gaseous fuel to said furnace and a controllable water heater gaseous fuel valve in communication with said water heater, said water heater gaseous fuel valve controlling a flow of gaseous fuel to said water heater.

19. A common, side-wall, vented gaseous fuel-fired furnace and gaseous fuel-fired water heater system in accordance with claim 18 further comprising control means for controlling said furnace gaseous fuel valve and said water heater gaseous fuel valve.

* * * * *